United States Patent [19]

Currall

[11] Patent Number: 4,515,314

[45] Date of Patent: May 7, 1985

[54] LIQUID SPRAY APPARATUS

[75] Inventor: William J. P. Currall, Swindon, England

[73] Assignee: Plessey Overseas Limited, Ilford, England

[21] Appl. No.: 438,388

[22] Filed: Nov. 1, 1982

[30] Foreign Application Priority Data

Nov. 3, 1981 [GB] United Kingdom ..... 8133077
Nov. 14, 1981 [GB] United Kingdom ..... 8134383

[51] Int. Cl.[3] ..... B05B 1/34

[52] U.S. Cl. ..... 239/466; 239/474; 239/489

[58] Field of Search ..... 239/222.17, 222.19, 239/380–382, 464, 474, 476, 477, 482–484, 487–489, 461, 463, 466, 467

[56] References Cited

U.S. PATENT DOCUMENTS 1,435,778 11/1922 Williams ..... 239/488 X
2,131,936 10/1938 Del Genovese ..... 239/477
2,408,196 9/1946 Carlson ..... 239/222.17 X

FOREIGN PATENT DOCUMENTS 119162 10/1942 Australia ..... 239/488
479235 2/1938 United Kingdom .
501371 2/1939 United Kingdom .
555736 9/1943 United Kingdom .
752333 7/1956 United Kingdom .
797196 6/1958 United Kingdom .
1124368 8/1968 United Kingdom .

*Primary Examiner*—Andres Kashnikow
*Attorney, Agent, or Firm*—Fleit, Jacobson, Cohn & Price

[57] ABSTRACT

Liquid spray apparatus suitable for use in an electrostatic spraying system comprises a liquid supply duct, a conical surface at one end of the duct on to which the liquid is adapted to impinge and an annular nozzle for distributing the liquid after it has passed over the surface. Channels for imparting a swirling motion to the liquid are provided consisting of snail-shaped grooves formed in the conical disc or helical channels formed in the duct. A valve member is provided for varying the flow rate of the liquid through the apparatus.

10 Claims, 10 Drawing Figures

LIQUID SPRAY APPARATUS

Figure 1:
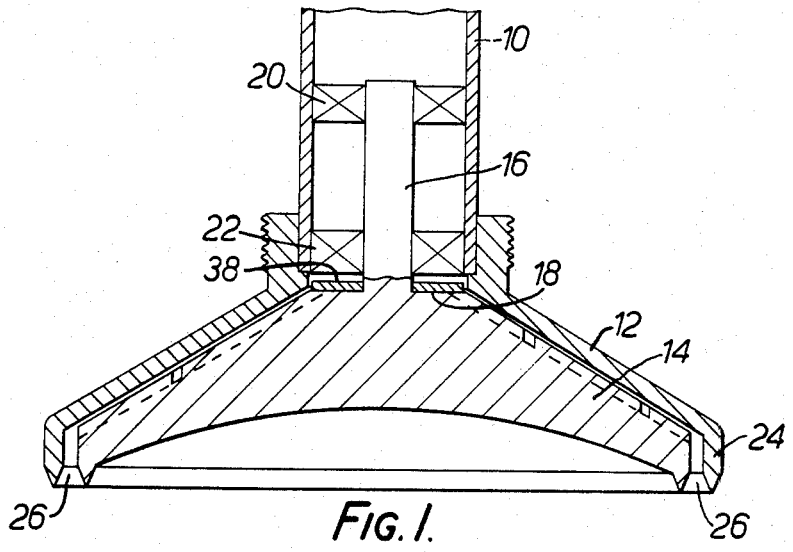

This invention relates to liquid spray apparatus and particularly but not exclusively to liquid spray apparatus for use in an electrostatic liquid spraying apparatus.

An electrostatic liquid spraying apparatus usually comprises a conducting surface on to which the liquid spray impinges and an earthed field intensifying electrode mounted adjacent to the conductive surface. When the conducting surface is electrically charged to a potential of the order of 1–20 kilovolts the electrostatic field at the surface causes the liquid spray droplets to atomize and form electrically charged particles which are projected away from the field intensifying electrode.

It is an object of the present invention to provide liquid spray apparatus which will assist the atomisation of the spray droplets when used in an electrostatic spraying apparatus and in which the rate of flow of the liquid droplets can readily be varied.

According to the present invention liquid spray apparatus comprises a liquid supply duct, a surface at one end of the duct on to which the liquid is adapted to impinge, a nozzle for distributing the liquid after it has passed over the surface, means for imparting a swirling motion to the liquid and means for varying the flow rate of liquid through the liquid spray apparatus.

Preferably a cover member is located adjacent to the surface to form a nozzle between it and the surface.

Preferably the surface comprises a circular disc with a central axis, the liquid supply duct leading to a central portion of the disc.

The disc may be provided with a plurality of channels extending from the central portion of the disc to the periphery of the disc, the longitudinal axis of each channel being shaped to form a small acute angle with the periphery of the disc whereby a swirl is imparted to the liquid when it leaves the periphery of the disc.

Preferably the axes of the channels extend from the central portion of the disc and meet the periphery of the disc at a point with an extremely small acute angle to a tangent to the periphery at that point or meet the periphery of the disc substantially tangentially thereto.

Thus the axis of each channel may take the form of a lemniscate.

Preferably the cover member is shaped to form an annular gap between the periphery of the disc and the edge of the cover member forming an annular nozzle.

The means for varying the flow rate of liquid through the liquid spray apparatus may comprise valve means provided on the central portion of the disc to permit liquid to enter a predetermined number of the channels only and to prevent liquid from entering any of the channels.

The valve means may comprise a plate having a plurality of orifices, rotation of the plate relative to the disc aligning one or more orifices with the one or more ends of the channels.

Alternatively, the liquid supply duct may include a plurality of helical channels to impart a swirl to the liquid, the valve means being located upstream of the helical channels.

Instead of the plate having a plurality of holes the means for varying the flow rate of liquid through the liquid spray apparatus may comprise first and second splined members located within a hollow portion of the liquid supply duct, the second splined member abutting the end of the first splined member, the outer ends of the splines of each splined member cooperating with the walls of the duct so that the liquid is constrained to flow along the spaces between the splines, the first and second splined members being relatively rotatable such that the splines on the first and second members can be moved in and out of alignment whereby the rate of flow of liquid through the spaces is varied.

The cross-sectional shape of the splines may be the same on each splined member such that the flow of liquid can be varied from a minimum to a maximum amount or the cross-sectional shape of the splines on one of the splined members may be the same as the cross-sectional shape of the spaces between the splines on the other splined member whereby the flow of liquid can be prevented.

Suitable means are preferably provided for relatively moving the splined members externally of the duct.

Figure 2:
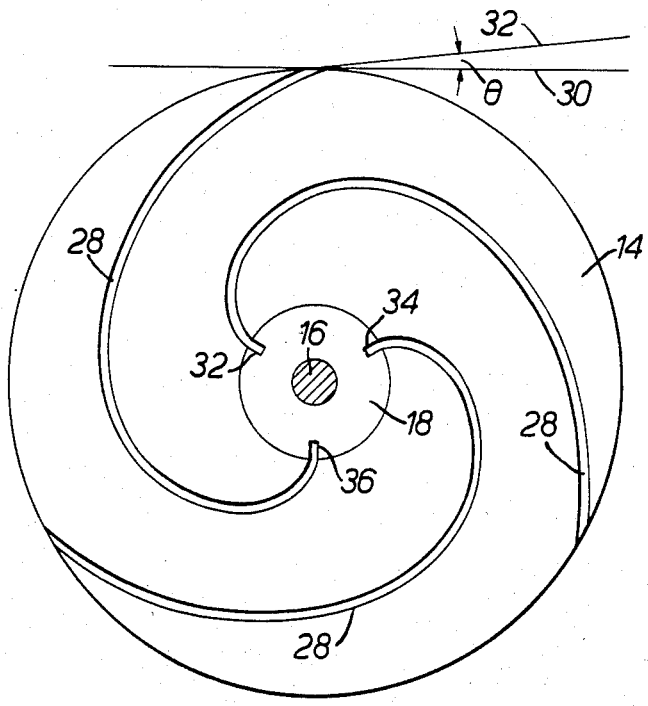
Figure 3:
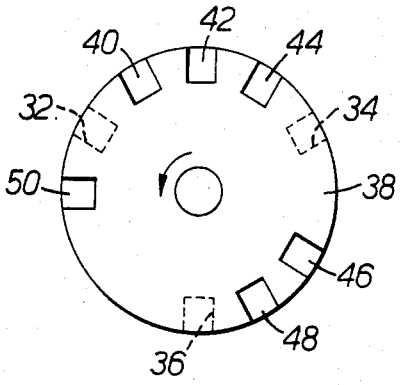
Figure 4:
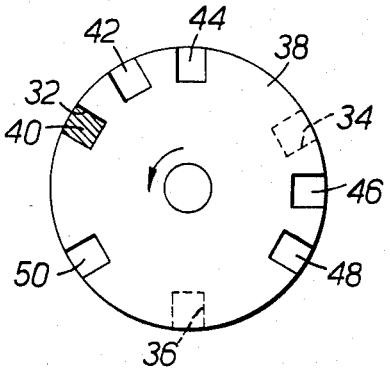
Figure 5:
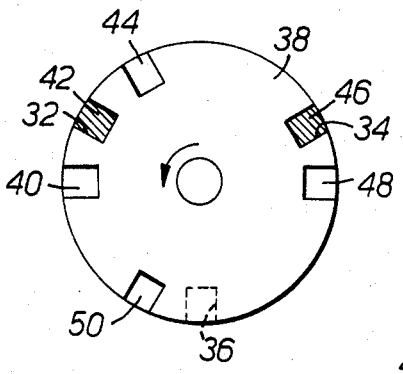
Figure 6:
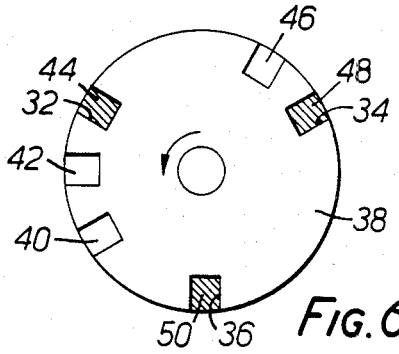
Figure 7:
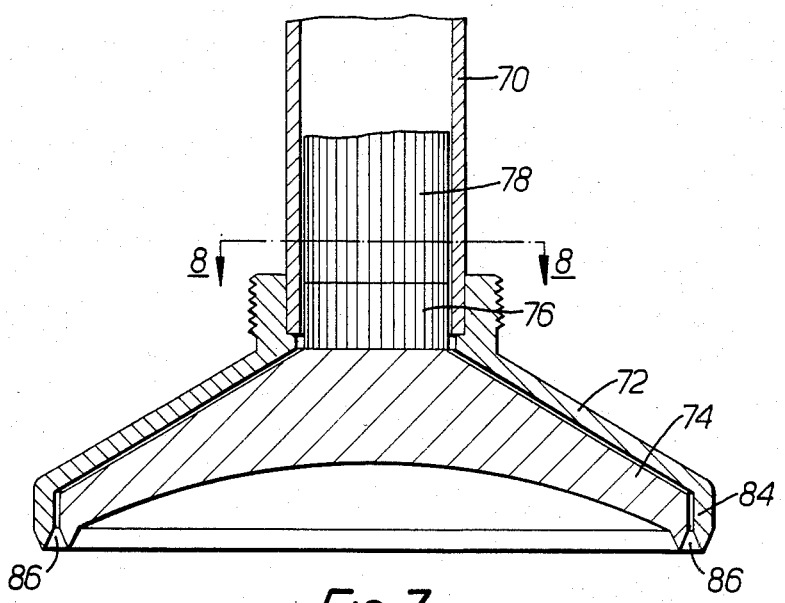
Figure 8A:
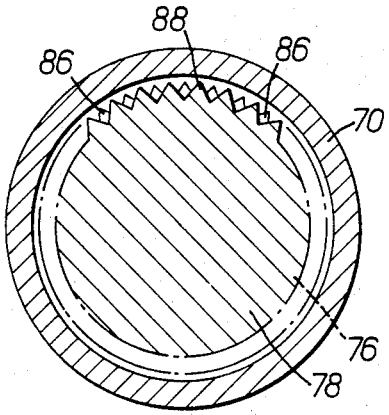
Figure 8B:
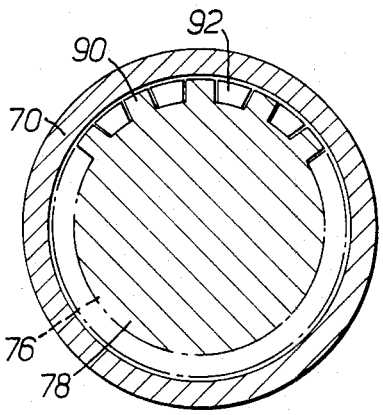
Figure 9:
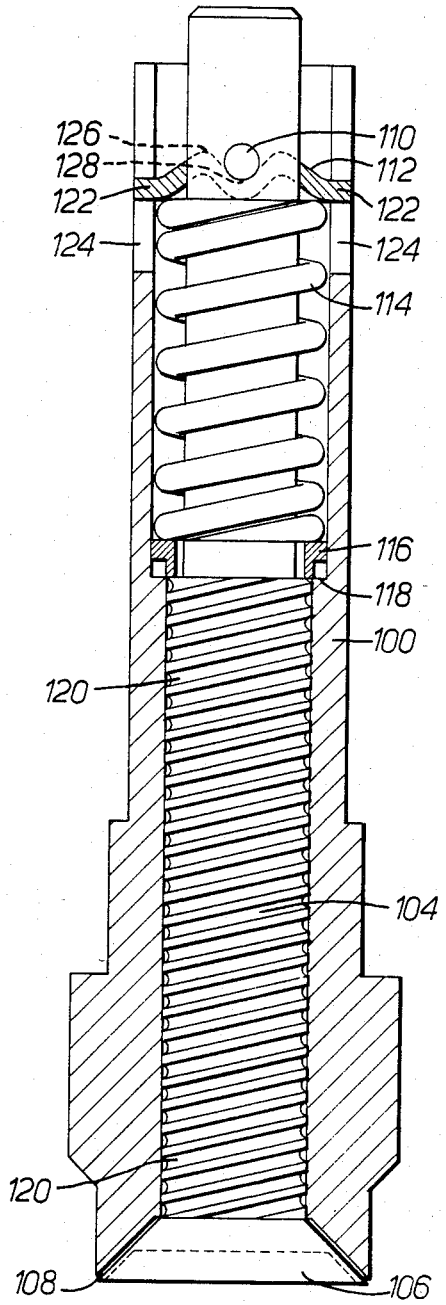

Embodiments of the invention will now be described by way of example only with reference to the accompanying drawings in which:

FIG. 1 is a cross-sectional view of a liquid spray apparatus constructed in accordance with the invention, FIG. 2 is a plan view of a disc forming part of the liquid spray apparatus, FIGS. 3 to 6 are plan views of a valve illustrating various positions of the valve, FIG. 7 is a cross-sectional view of an alternative embodiment of a liquid spray apparatus according to the invention, FIGS. 8*a* and 8*b* are two alternative cross-sectional views taken along line 8—8 on FIG. 7 and FIG. 9 is a view of a further embodiment of liquid spray apparatus according to the invention.

The liquid spray apparatus shown in FIG. 1 comprises a hollow liquid supply tube 10 which is secured to a conical cover 12. A conical disc 14 having a shaft 16 extending from a central flat portion 18 of the disc is supported inside the cover 12 by bearings 20 and 22 in which the shaft 16 is supported. The cover 12 is in intimate contact with the conical surface of the disc 14 and is provided at its lower end with a circular flange 24. The flange 24 is spaced from the periphery of the disc to produce an annular gap 26 therebetween.

In the conical surface of the disc 14 are formed three channels 28, each having a lemniscate or snail shape and extending from the central flat portion 18 to the periphery of the disc. Thus the longitudinal axis 32 of each channel 28 initially extends radially outwardly from the flat portion 18 and curves to meet the periphery of the disc at a point substantially tangentially or at a very small acute angle $\theta$ to a tangent 30 to the periphery at that point.

On the flat portion 18 of the disc 14 is located a valve which is adapted to block the ends 32, 34 and 36 of one, two or all three of the channels 28 and hence vary the flow rate of liquid through the spraying apparatus between a maximum value and zero. The valve comprises a plate 38 which is secured inside the tube 10 and the disc 14 is rotatable relative to the plate 38 through four different positions. Rotation of the disc 14 is achieved manually and the disc can be located in any of its four different positions by means not shown.

The four relative positions of the disc 14 and the plate 38 are illustrated in FIGS. 3 to 6 which show the plate 14 which includes the three ends 32, 34 and 36 of the channels 28. The plate 38 has six slots 40, 42, 44, 46, 48 and 50 each corresponding to the shape of the ends 32, 34 and 36, and these slots are positioned so that in the first position (FIG. 3) the plate 38 covers all the ends 32, 34 and 36. In its second position (FIG. 4) the plate 38 has been rotated in an anti-clockwise direction relative to the disc 14 and the slot 40 is aligned with the end 32, the ends 34 and 36 remaining covered. In the third position (FIG. 5) the plate 38 is further rotated in an anticlockwise direction relative to the disc 14, and the slot 42 is aligned with the end 32, the slot 46 is aligned with the end 34 and the end 36 is covered. Further anti-clockwise rotation of the plate 38 relative to the disc 14 into the fourth position (FIG. 6) aligns the slot 14 with the end 32, the slot 48 with the end 34 and the slot 50 with the end 36. The disc 14 can thus be adjusted so that all, two, one or none of three of the ends 32, 34 and 36 are covered to vary the flow of liquid from zero to a maximum value respectively.

In operation of the liquid spray apparatus a liquid to be sprayed is supplied down the tube 10 and through the slots in the plate 38 which are aligned with the ends 32, 34 and 36 of the channels 28. The liquid flows down the relevant channels 28, being retained in the channels by the proximity of the cover 12 to the conical portion of the disc 14, and exits substantially tangentially from the ends of the channels 28 into the annular gap 26. An annular spray thus emanates from the gap 26 depending on the rate of flow of liquid or a pressure supply of air which may also be supplied down the tube 10.

The spray apparatus is particularly suitable for use in an electrostatic spraying system. Thus the disc 14 can be made of a conducting material and electrically charged to a potential of 1 to 20 kilovolts whilst an earthed field intensifying electrode can be formed around the outside of the cover 12 or be formed in the cover 12 if the cover is made of an insulating material. The spray droplets are atomised when they hit the surface of the disc 14 and atomisation is achieved to a high order by the combination of inertial and electrostatic forces.

The liquid spray apparatus shown in FIG. 7 comprises a hollow liquid supply tube 70 which is secured to a conical cover 72. A conical disc 74 is supported inside the cover 72 by a splined shaft 76 which is itself supported by a further splined shaft 78 which is rigidly supported inside the tube 70. The cover 72 is located very close to the conical surface of the disc 74 and is provided at its lower end with a circular flange 84. The flange 84 is spaced from the periphery of the disc to produce an annular gap 86 therebetween.

The splined shaft 76 is rotatable relative to the further splined shaft 78 and the splines 88 and 86 on the shafts 78 and 76 respectively are shown in FIG. 8*a*. The splines 88 are substantially triangular in section and thus leave a number of substantially triangular passages between the shaft 78 and the wall of the tube 70. The splines 86 on the shaft 76 are similar in shape and have similar passages therebetween, and liquid when supplied down the tube 70 passes down the passages between the shaft 78 and the tube 70. When the passages between the shafts 76 and 78 and the tube 70 are aligned, the liquid can pass down these passages without further restriction on to the surface of the disc 74 and eventually out of the annular gap 86. When the shaft 76 is rotated relative to the shaft 78, the passages move out of alignment as shown in FIG. 8*a* and the flow of liquid past the shafts 78 and 76 is restricted, the lowest flow rate being when the splines 86 of the shaft 76 are aligned with the centres of the passages between the splines 88 of the shaft 78.

FIG. 8*b* illustrates an alternative shape for the splines of shaft 78 and the splines of the shaft 76. In this example the splines 90 on the shaft 78 are substantially square-shaped and the splines 92 of the shaft 76 are of similar cross-sectional shape to the passages between the splines 90. It will be seen that when the splines 30 and 32 are 180° out of phase no through passages exist between the shafts 78 and 76 and the tube 70, thus enabling the liquid supply to the spray to be stopped. As the shaft 76 is rotated to bring the splines back into alignment the flow of liquid gradually increases to a maximum value. The shaft 76 may be rotated by rotating the disc 74 inside the cover 72, suitable means being provided for locking the disc 74 in a predetermined position.

Again this spray apparatus is particularly suitable for use in an electrostatic spraying system.

The liquid spray apparatus illustrated in FIG. 9 comprises a hollow liquid supply tube 100 the lower end of its internal surface being formed into a conical flare 102. Inside the tube 100 is located a shaft 104 which extends through the entire length of the tube 100 and which has a conical flared surface 106 formed at its lower end. The surface 106 is spaced from the flared surface 102 of the tube 100 by suitable projections or ribs (not shown). The annular gap thus formed defines a spray nozzle 108.

The shaft 104 is held in position in the tube 100 by a pin 110 which extends through the shaft 104 and abuts a spring urged washer 112, the compression spring 114 therefore urging the shaft 104 upwards in the tube 100 and maintaining the nozzle 108 at the correct size. The lower end of the spring 114 abuts a plate 116 which itself abuts a shoulder 118 formed inside the tube 100. The shaft 100, below the position of the shoulder 118 is provided with a plurality of helical grooves on its outer surface which co-operate with the internal wall of the tube 100 to form helical passages 120. In this example there are three helical passages and the plate 116 is formed as the plate 38 in FIGS. 3, 4, 5 and 6 to block the upper ends of one, two or all three of the passages 120 and hence vary the flow rate of liquid through the spraying apparatus between the maximum value and zero.

The tube 100 is rotatable on the shaft 104 whilst the plate 116 is secured to the tube 100 and the washer 112 is prevented from rotation inside the tube by side members 122 which engage longitudinally extending slots 124 formed at the upper end of the tube 100. The washer 122 is provided with alternate projections 126 and depressions 128 arranged circumferentially on its surface so that as the tube 100 rotates the pin 110 rides over the projections 126 and enters the next depressions. 128 The washer 12 comprises the spring 114 as this happens and thus the position of the plate 116 relative to the helical passages 120 can be adjusted and hence the rate of flow of liquid can be varied.

The helical passages 120 cause the liquid to swirl before it hits the conical surface 106 from which the liquid leaves the apparatus through the nozzle 108.

I claim:

1. Liquid spray apparatus comprising a liquid supply duct, a surface at one end of the duct onto which the liquid is adapted to impinge, a nozzle for distributing the liquid after it has passed over the surface, means for imparting a swirling motion to the liquid and means for varying the flow rate of liquid through the liquid spray apparatus, in which the means for varying the flow rate of liquid through the liquid spray apparatus comprises first and second splined members located within a hollow portion of the liquid supply duct, the second splined member abutting the end of the first splined member, the outer ends of the splines of each splined member cooperating with the walls of the duct so that the liquid is constrained to flow along the spaces between the splines, the first and second splined members being relatively rotatable such that the splines on the first and second members can be moved in and out of alignment whereby the rate of flow of liquid through the spaces is varied.

2. Liquid spray apparatus according to claim 1 in which a cover member is located adjacent to the surface to form said nozzle between it and the surface.

3. Liquid spray apparatus according to claim 1 in which the surface comprises a circular disc with a central axis, the liquid supply duct leading to a central portion of the disc.

4. Liquid spray apparatus as claimed in claim 3 in which the disc is provided with a plurality of channels extending from the central portion of the disc to the periphery of the disc, the longitudinal axis of each channel being shaped to form a small acute angle with the periphery of the disc whereby a swirl is imparted to the liquid when it leaves the periphery of the disc.

5. Liquid spray apparatus according to claim 4 in which the axes of the channels extend from the central portion of the disc and meet the periphery of the disc at a point with an extremely small acute angle to a tangent to the periphery at that point or meet the periphery of the disc substantially tangentially thereto.

6. Liquid spray apparatus according to claim 4 in which the axis of each channel takes the form of a lemniscate.

7. Liquid spray apparatus as claimed in claim 3 in which a cover member is shaped to form an annular gap between the periphery of the disc and the edge of the cover member forming an annular nozzle.

8. Liquid spray apparatus as claimed in claim 1 in which the cross-sectional shape of the splines is the same on each splined member such that the flow of liquid can be varied from a minimum to a maximum amount.

9. Liquid spray apparatus as claimed in claim 1 in which the cross-sectional shape of the splines on one of the splined members is the same as the cross-sectional shape of the spaces between the splines on the other splined member whereby the flow of liquid can be prevented.

10. Liquid spray apparatus as claimed in claim 1 in which suitable means are provided for relatively moving the splined members externally of the duct.

* * * * *